United States Patent [19]

Szabo

[11] Patent Number: 4,862,805

[45] Date of Patent: Sep. 5, 1989

[54] FIRE-ARM CARTRIDGE WITH FRANGIBLE PROJECTILE

[76] Inventor: Attila Szabo, No. 3 Concord Pl. apt. 2701, Don Mills, Ontario, Canada, M3C 3K7

[21] Appl. No.: 236,905

[22] Filed: Aug. 26, 1988

[51] Int. Cl.[4] ..... F42B 11/18

[52] U.S. Cl. ..... 102/444; 102/204; 102/430; 102/470

[58] Field of Search ..... 102/204, 430, 444–447, 102/469, 470, 513, 466; 42/76.01

[56] References Cited

U.S. PATENT DOCUMENTS

| | | | |
|---|---|---|---|
| 1,760,731 | 5/1930 | Williams | 42/76.01 |
| 4,455,942 | 6/1984 | Murray et al. | 102/444 |
| 4,686,905 | 8/1987 | Szabo | 102/444 |

*Primary Examiner*—Harold J. Tudor

[57] ABSTRACT

This cartridge includes a tubular casing with a firing pin member fixed within the casing intermediate its ends. A frangible projectile is frictionally and sealingly retained in the front compartment of the casing. A piston is located in the rear compartment and consists of a transverse wall exposed at the rear end of the casing, and of a forwardly-extending sleeve slidable within the rear compartment. A primer cap is located within the piston sleeve and has a transverse deformable wall abutting against a boss rearwardly projecting from the firing pin member. The latter includes passages communicating the rear and front compartments. When a plunger actuated by the firing arm pushes the piston forwardly, the firing boss deforms the primer cap transverse wall and cause detonation of the propellant charge. The propellant gases first move the piston rearwardly to uncover the firing cap housing, whereby the gases are expanded in the rear compartment before reaching behind the projectile in the front compartment. Therefore, the projectile is propelled without being ruptured.

12 Claims, 1 Drawing Sheet

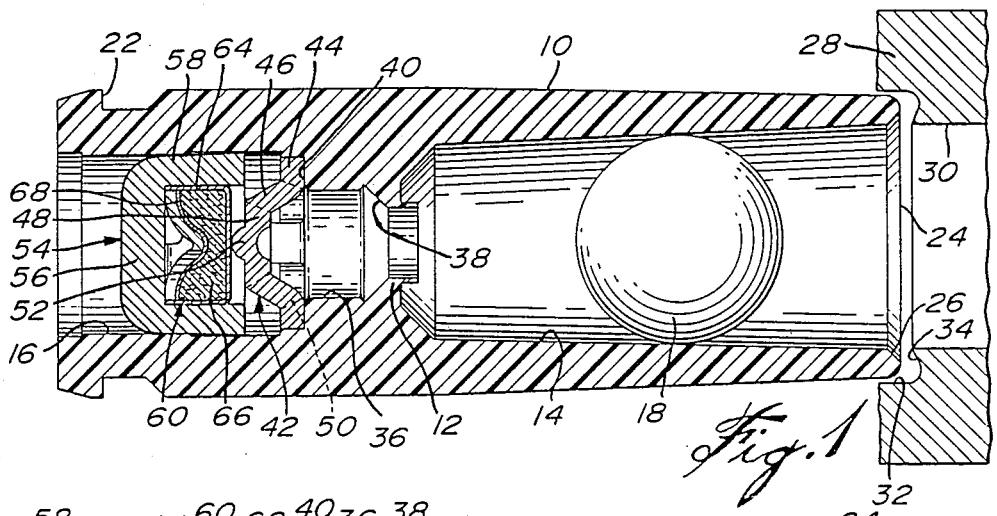
Fig. 1
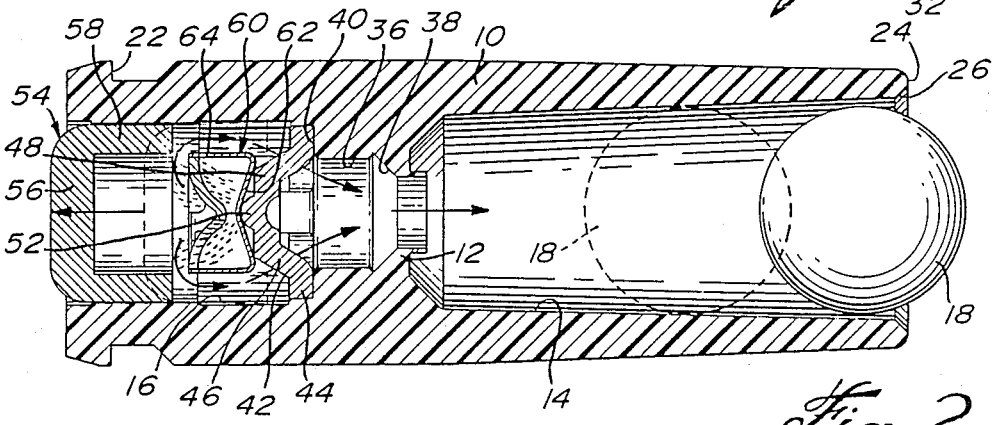
Fig. 2
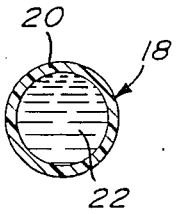
Fig. 4
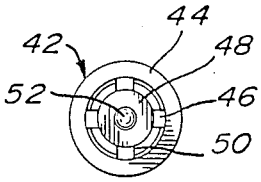
Fig. 3
Fig. 6
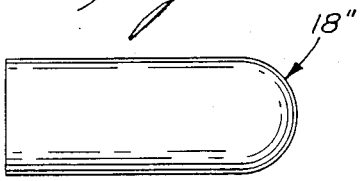
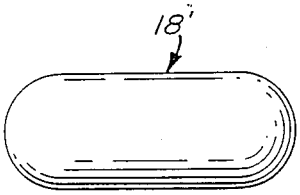
Fig. 5

FIRE-ARM CARTRIDGE WITH FRANGIBLE PROJECTILE

FIELD OF THE INVENTION

The present invention relates to cartridges for fire-arms and, more particularly, to cartridges of the type in which the projectile is frangible or easily rupturable.

BACKGROUND OF THE INVENTION

In applicant's prior U.S. Pat. Ser. No. 4,686,905 dated March 10, 1987 and entitled: Fire-Arm Cartridge With A Frangible Projectile, there is described an arrangment in which the propellant gases are first caused to expand in a rear compartment of the cartridge casing before reaching behind the projectile, thus exerting a lower propellant force on the latter than in a conventional cartridge. This lower force is sufficient to propel the projectile to the target but without rupturing the same until the projectile impacts on the target. Examples of projectiles used in the cartridge in accordance with the above-noted patent are an envelope containing a colored liquid or a gas or a powder.

OBJECTS OF THE INVENTION

It is the general object of the present invention to provide a cartridge of improved and simpler construction and used for the same purpose as in the above-noted patent.

Another object of the present invention is to provide a cartridge of the character described, in which a standard conventional primer cap is used as the propellant charge.

Another object of the present invention is to provide a cartridge of the character described, in which the projectile can have various configurations.

SUMMARY OF THE INVENTION

The fire-arm cartridge of the invention comprises an open-ended tubular casing, a firing pin member fixedly located in the casing intermediate its ends and defining in the casing a front and a rear compartment, the firing pin member including a central rearwardly-extending firing boss and passages around said firing boss which communicate the front and rear compartments. A frangible projectile is frictionally and sealingly retained in the front compartment; a piston is located in the rear compartment and includes a rigid piston transverse wall exposed at the rear open end of the casing and a sleeve forwardly extending from the piston transverse wall and in slidable and sealing engagement with the rear compartment: a primer cap is located in the piston and has a deformable primer cap transverse wall abutting the firing boss and deformable thereby, and a rearwardly-extending flange in slidable and sealing engagement with the sleeve and abutting the piston transverse wall. A propellant charge is contained in the primer cap. Preferably, the tubular casing has an intermediate restriction with a central aperture. Said restriction forms a rearwardly-facing annular step surrounding the aperture. The firing pin member comprises an annular skirt abutting said step; a central part; radial arms joining said central part and said skirt, said arms radially outwardly inclined in the forward direction from said central part, so that the central part is located rearwardly of the skirt, passages being formed between the arms; and a protuberance rearwardly protruding from said central part. Preferably, the casing is made of a synthetic resin and its front edge is radially inwardly rearwardly tapered to be retained against inward collapse by a mating step in the fire-arm barrel in which the cartridge is fitted.

The invention is also directed to a fire-arm for use with the cartridge in accordance with the invention, the fire-arm having a barrel with a main bore and a rear and large cartridge receiving bore portion, the junction between the main bore and the bore portion defining an annular step facing rearwardly and radially inwardly rearwardly tapered to conform with the front edge of the cartridge casing when said front edge abuts against said step. Preferably, the projectile is a hollow gelatin capsule rupturable upon impact and filled with a fluid. The projectile can have a spherical shape or an elongated cylindrical shape with two rounded ends or with one rounded end and the other end being a flat.

BRIEF DESCRIPTION OF THE DRAWINGS

In the drawings:

FIG. 1 is a longitudinal section of the cartridge in accordance with the invention, fitted within a fire-arm barrel, partially shown in longitudinal section;

FIG. 2 is a longitudinal section of the cartridge, similar to that of FIG. 1, but shown just after firing;

FIG. 3 is a rear end elevation of the firing pin member;

FIG. 4 is a cross-section of the projectile; and

FIGS. 5 and 6 are elevations of other embodiments of the projectile.

DETAILED DESCRIPTION OF THE INVENTION

The cartridge of the invention includes a generally cylindrical casing 10, made of synthetic resin, injection-molded in one piece and defining a restriction 12 intermediate the two open ends of the casing 10. The restriction 12 defines with casing 10 a front casing compartment 14 and a rear casing compartment 16. In the front compartment 14, is located a frangible projectile 18. Preferably, the projectile 18 consists of a gelatin shell 20, filled with a colored liquid 22. However, the liquid could be replaced by gas. The shell 20 may have a spherical shape, as shown in FIGS. 1 and 2 or an elongated cylindrical shape, as shown at 18' in FIG. 5, with two rounded ends; or an elongated cylindrical shape, as shown in FIG. 6, at 18" with with one rounded end and the other end being flat.

The front compartment 14 preferably slightly flares in the forward direction from a diameter slightly smaller to a diameter slightly greater than the diameter of the projectile 18, 18' or 18". The latter is frictionally and sealingly retained in the front compartment 14. The rear compartment 16 is of cylindrical shape. The external surface of casing 10 is provided with an annular groove 22 adjacent its rear end for conventional ejection of the cartridge by the ejector of the fire-arm after firing of the cartridge The front edge 24 of the cartridge has an inwardly radially rearwardly tapering edge surface 26. The fire-arm in which the casing 10 is to be fired has a barrel 28 providing a main bore portion 30 through which the projectile 18 is to be propelled, and a rear enlarged bore portion 32 in which the cartridge 10 is to be fitted for firing.

The junction between main bore 30 and rear bore portion 32 forms a step 34 against which the front edge of the casing 10 abuts. Said step is radially inwardly rearwardly directed to fit the tapering edge surface 26 at the front of casing 10. Therefore, step 34 retains the front portion of the casing 10 against radially inward collapse right after firing of the cartridge, a phenomenum which has been found to occur if the step 34 was to be radially directed.

The restriction 12 defines a cylindrical aperture 36 directly opening in the rear compartment 16, this aperture 36 being extended by a forwardly-tapering front aperture portion 38. The aperture 36, 38 establishes communication between the front and the rear compartments 14 and 16. The restriction 12 defines around aperture 36, 38 a rearwardly-facing annular step 40 against which abuts a firing member 42. The firing member 42 is preferably made of steel and is shown in section in FIG. 1, and in elevation in FIG. 3. The firing member 42 includes an annular skirt 44, which abuts against step 40. Angularly equally spaced radial arms 46 integrally connect skirt 44 with a central part 48. Apertures 50 are defined between arm 46. The latter are radially inwardly rearwardly inclined, whereby central part 48 is maintained in a plane parallel to the skirt 44 and rearwardly offset with respect to the latter.

A rearwardly-directed central rounded protuberance 52 is formed on central part 48 and serves as a firing pin. A piston member 54 is located within the rear compartment 16. Piston member 54 includes a rigid transverse piston wall 56 and an integral forwardly-extending cylindrical sleeve 58.

The transverse wall 56 is fully exposed at the open end of the rear compartment 16. The sleeve 58 is in sealing and slidable contact with the inner cylindrical surface of the rear compartment 16. Piston 54 is preferably made of steel.

A firing cap 60, of conventional construction, is inserted within the piston 54. The firing cap 60 comprises a thin metallic housing, of generally cylindrical shape, defining a deformable transverse wall 62 and a rearwardly-directed cylindrical flange 64. The transverse wall 62 is made of abut against the protuberance 52 of the firing pin member 42.

The housing of the firing cap is filled with a propellant charge 66 which is retained therein by a thin membrane 68, the latter facing the transverse wall 56 of the piston 54. The cylindrical flange 64 of the firing cap 60 is in sealing and frictional contact with the inside surface of the sleeve 58 of the piston 54.

The firing cap 60 is completely located within the piston 54.

The conventional firing pin of the fire-arm is replaced by a cylindrical plunger of a diameter slightly smaller than that of the rear compartment and adapted, upon pulling of the trigger, to enter the rear compartment and strike against the piston 54. The piston is moved forwardly upon impact and, therefore, the protuberance 52 of the firing pin member 42 deforms the thin transverse wall 62 of the firing cap 60, as shown in FIG. 2, causing the propellant charge 66 to detonate. The resulting propellant gases must first cause rearward movement of the piston 54 and, therefore recocking of the firing mechanism of the fire-arm, in order to clear the cylindrical flange 64 of the firing cap 60, before the propellant gases are allowed to flow around the firing cap and then through the passages 50 of the firing pin member 42, and then through the central aperture 36, 38 of the restriction 12 to eventually build up a pressure behind the projectile 18, 18' or 18'' sufficient to propel the same to its target but of unsufficient force to rupture the projectile while still in the cartridge or in the barrel of the fire-arm.

I claim:

1. A fire-arm cartridge comprising an open-ended tubular casing, a firing pin member fixedly located in said casing intermediate its ends and defining in the casing a front and a rear compartment, said firing pin member including a central rearwardly-extending firing boss and passages around said firing boss, said passages communicating said front and rear compartments, a frangible projectile frictionally and sealingly retained in said front compartment, a piston located in said rear compartment and including a rigid piston transverse wall exposed at the rear open end of said casing and a sleeve forwardly extending from said piston transverse wall and in slidable engagement with said rear compartment, a primer cap located in said piston and having a deformable primer cap transverse wall abutting said firing boss and deformable thereby, and a rearwardly-extending flange in slidable and sealing engagement with said sleeve and abutting said piston transverse wall, and a propellant charge located in said primer cap; forward movement of said piston forwardly moving said primer cap and producing deformation of said primer cap transverse wall by said firing boss and consequent detonation of said propellant charge which produces propellant gases which must first move said piston rearwardly in said rear compartment to a position in which its sleeve clears said flange and establishes communication between the inside of said firing cap and said front compartment behind said projectile around said flange and through said passages.

2. A fire-arm cartridge comprising an open-ended tubular casing having an intermediate restriction defining in the casing a front and a rear compartment, said restriction defining a central aperture communicating said front and rear compartment and forming a rearwardly-facing annular step surrounding said aperture and said rear compartment, a frangible projectile frictionally and sealingly retained in said front compartment, a firing pin member located in said rear compartment and comprising an annular skirt abutting said step, a central part, radial arms joining said central part and said skirt, said arms radially outwardly inclined in the forward direction from said central part, so that said central part is located rearwardly of said skirt, passages being formed between said arms, said skirt and central part, said passages communicating said aperture and said rear compartment, a protuberance rearwardly protruding from said central part and serving as a firing pin, a piston including a rigid piston transverse wall and a sleeve forwardly extending from said transverse wall and in slidable and in sealing engagement with said rear compartment, said piston movable between a forward position and a rearward position, a primer cap located in said sleeve and having a deformable primer cap transverse wall abutting said protuberance, and a rearwardly-extending cylindrical flange in slidable and sealing engagement with said sleeve and abutting said piston transverse wall, and a propellant charge located in said cap, said piston transverse wall exposed at the rear of said casing and, upon being pushed forward, forwardly moving said primer cap and producing deformation of said primer cap transverse wall by said protuberance and detonation of said propellant charge producing propellant gases which act on said piston and cause rearward movement of the latter from its forward position to a rearward position, in which its sleeve disengages the flange of said primer cap and establishes a communication between the interior of said firing cap and said front compartment at the back of said projectile, around said cylindrical flange and through said passages and aperture, whereby said propellant gears must move said piston rearwardly of said casing before they can propel said projectile.

3. A fire-arm cartridge as defined in claim 1, wherein said casing is made of synthetic resin and wherein the front edge of said casing is radially inwardly, rearwardly tapered to be retained against inward collapse by a mating step in the fire-arm barrel, in which the cartridge is fitted.

4. A fire-arm cartridge as defined in claim 2, wherein said casing is made of synthetic resin and wherein the front edge of said casing is radially inwardly rearwardly tapered to be retained against inward collapse by a mating step in the fire-arm barrel, in which the cartridge is fitted.

5. A fire-arm cartridge as defined in claim 2, wherein said aperture defines a generally cylindrical rear portion and a front portion which has a forwardly-tapering surface.

6. A fire-arm cartridge as defined in claim 1, wherein said projectile is a hollow gelatin capsule rupturable upon impact and filled with a fluid.

7. A fire-arm cartridge as defined in claim 2, wherein said projectile is a hollow gelatin capsule rupturable upon impact and filled with a colored liquid.

8. A fire-arm cartridge as defined in claim 6, wherein said capsule has a spherical shape.

9. A fire-arm cartridge as defined in claim 6, wherein said capsule has a cylindrical shape with rounded ends.

10. A fire-arm cartridge as defined in claim 6, wherein said capsule has a cylindrical shape with one rounded end and an opposite flat end.

11. A fire-arm cartridge as defined in claim 8, wherein said front compartment of said casing flares from rear to front from a diameter smaller than to a diameter greater than the external diameter of said capsule.

12. A fire-arm cartridge as defined in claim 2, wherein said annular skirt has a rear face against which the front edge of said sleeve comes to abut when pushed forwardly.

* * * * *